United States Patent [19]

Hastings et al.

[11] 4,105,883

[45] Aug. 8, 1978

[54] ELECTRIC SWITCH HAVING A FRAME WITH IMPROVED SNAP-IN BASE RETENTION MEANS

[75] Inventors: Jerome K. Hastings, Sussex; Earl T. Piber, Oconomowoc, both of Wis.

[73] Assignee: Cutler-Hammer, Inc., Milwaukee, Wis.

[21] Appl. No.: 694,389

[22] Filed: Jun. 9, 1976

[51] Int. Cl.[2] ..... H01H 9/00

[52] U.S. Cl. ..... 200/296; 248/309 R

[58] Field of Search ..... 200/296, 295; 248/27.1, 248/27.3; 339/128, 126 R; 248/204, 316 R, 316 C, 316 D, 310, 309

[56] References Cited

U.S. PATENT DOCUMENTS

| | | | |
|---|---|---|---|
| 1,718,316 | 6/1929 | Swenson | 248/316 D |
| 3,061,258 | 10/1962 | Grenier | 248/309 X |
| 3,807,675 | 4/1974 | Seckerson et al. | 248/316 D |
| 3,941,965 | 3/1976 | Piber | 200/296 |
| 4,005,300 | 1/1977 | Piber | 200/296 |

*Primary Examiner*—J. V. Truhe
*Assistant Examiner*—D. A. Tone
*Attorney, Agent, or Firm*—Hugh R. Rather; William A. Autio; Michael E. Taken

[57] ABSTRACT

A toggle switch having a molded insulating frame including a pair of depending legs between which the insulating switch base is snap-in mounted and retained. The frame includes a bushing having a resilient collar for snap-in mounting of the switch in a hole in a mounting panel. This bushing pivotally retains the toggle lever for operating the switch contacts within the base. The legs of the frame are inwardly curved and tapered so that bases of varying tolerances may be retained thereby rigidly and securely.

8 Claims, 3 Drawing Figures

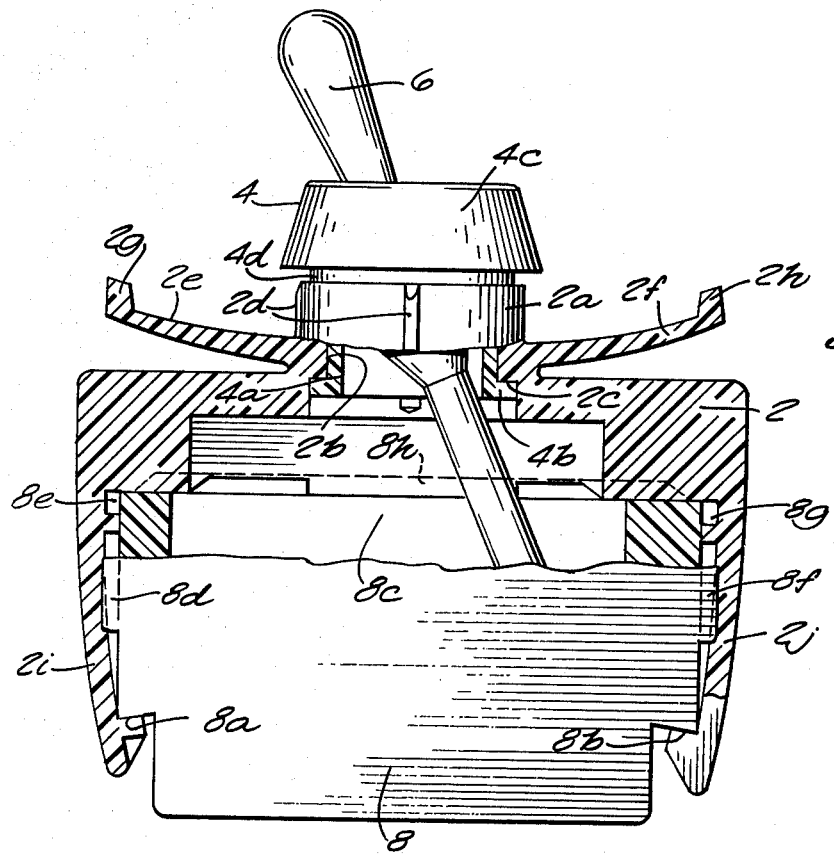
Fig. 1
Fig. 2
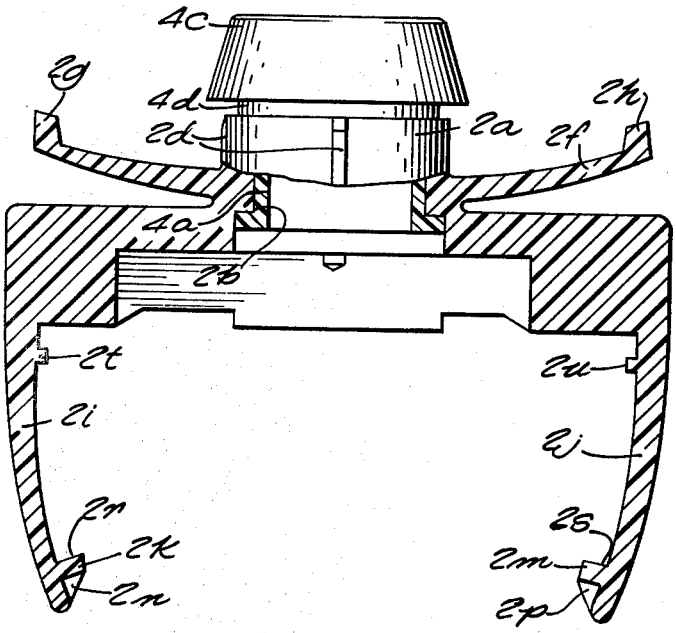
Fig. 3
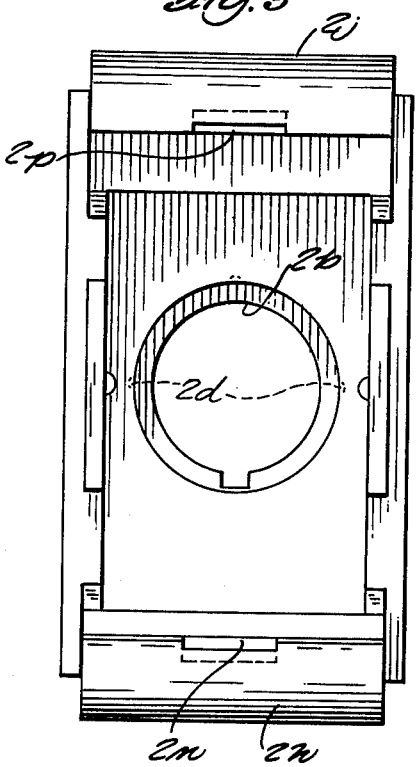

ELECTRIC SWITCH HAVING A FRAME WITH IMPROVED SNAP-IN BASE RETENTION MEANS

BACKGROUND OF THE INVENTION

Electric switches having a frame with snap-in base retention means have been known heretofore. For example, Earl T. Piber U.S. Pat. No. 3,941,965, dated Mar. 2, 1976, and assigned to the assignee of this invention, shows a switch frame having straight depending legs for snap-in mounting and retaining the switch base therebetween. While that construction has been useful for its intended purpose, this invention relates to improvements thereover.

SUMMARY OF THE INVENTION

An object of the invention is to provide an improved electric switch.

A more specific object of the invention is to provide an electric switch frame with improved snap-in means for retaining the switch base thereto.

Another specific object of the invention is to provide an electric switch frame with improved snap-in base retention means that will accommodate switch bases having various tolerances.

Other objects and advantages of the invention will hereinafter appear.

BRIEF DESCRIPTION OF THE DRAWINGS

FIG. 1 is a front elevational view of the switch with part of the frame in cross-section to show the curved and tapered legs of the switch frame retaining the switch base therebetween;

FIG. 2 is a view similar to FIG. 1 of only the bushing and frame subassembly showing the relaxed shape of the legs prior to assembly of the switch base; and FIG. 3 is a bottom view of the frame of FIG. 2.

DESCRIPTION OF THE PREFERRED EMBODIMENT

Referring to FIG. 1, there is shown a toggle switch constructed in accordance with the invention. As shown therein, this switch is provided with a frame 2 molded of plastic insulating material or the like. This frame is generally rectangular in top view, and also in bottom view as shown in FIG. 3, and is provided with a collar 2*a* at the top having a hole 2*b* for retaining a bushing 4 which also is molded of plastic insulating material. This bushing has a tubular liner portion 4*a* that fits snugly down through and lines the hole in the frame and is non-rotatably keyed therein. The lower end 4*b* of this liner portion is formed or flared below a shoulder 2*c* near the lower end of the hole in the frame to rigidly secure the bushing to the frame.

This bushing is provided with snap-in means for mounting the switch in a hole in a mounting panel. This means comprises a frusto-conical skirt 4*c* at the upper end of the bushing having a key slot in one side. This skirt is integral with the bushing and flared downwardly and outwardly from the upper end of the bushing. Clearance space 4*d* is provided beneath this skirt in the outer wall around the bushing above collar 2*a* so that this skirt can be squeezed as it is pushed through the hole in the mounting panel and snaps out or spreads out again on the other side of the panel to abut the front of the panel around the hole and thus secure the switch to the panel. The rim of the hole in the mounting panel surrounds collar 2*a* and vertical ribs 2*d* spaced around this collar take up any free play between the panel and the collar.

To keep the bushing skirt tight against the front of the panel, the frame is provided with a pair of back-up elements or springs such as lateral wings 2*e* and 2*f* as shown in FIG. 1. These wings are integrally molded with the frame and taper outwardly so that they are resilient. In addition, these wings have ramped risers 2*g* and 2*h* at their ends so that the wings flex as the collar is pushed through the hole in the panel and then resiliently push against the rear surface of the panel to pull the flared edge of the collar tight against the front of the panel.

The inner surface of the bushing is provided with suitable constriction means for pivotally retaining a toggle lever 6 that extends therethrough into base 8 for actuating the switch contacts therein.

As shown in FIGS. 2 and 3, frame 2 is provided with means for snap-in mounting of base 8 thereon and for accommodating bases having sightly differing dimensional tolerances. This means comprises a pair of tapered and curved legs 2*i* and 2*j* extending down from the opposite ends of the frame and integrally molded therewith and adapted to be snap-in assembled on and to grip the left and right ends of the base. These legs are generally rectangular plates that taper to a thinner cross-section toward their lower ends while also curving inwardly toward one another. Each leg is provided with an inwardly-directed hook or shoulder, 2*k* and 2*m*, at its lower end that is adapted to snap beneath an undercut notch or portion, 8*a–b*, at the corresponding end of the base, this hook extending laterally all the way across the corresponding leg. Center notches 2*n* and 2*p* on the respective hooks of these legs are adapted to receive a tool for spreading the legs to facilitate assembly of the base therebetween. These hooks are provided with inwardly and upwardly slanted upper surfaces 2*r* and 2*s* for engaging the undercut notches on the base.

These legs are also provided with means for centering the base with respect to the frame even if some flashing from the molding process remains at the upper left and right corners of the base. This means comprises small lateral ridges 2*t* and 2*u* on the inner surfaces near the tops of the legs. These ridges tend to break off any flashing at the upper corners of the base as the base is pushed into place between the legs. These ridges space the left and right ends of the base slightly from the legs and provide clearance above these ridges for any flashing that remains at the upper corners of the base thereby to allow centering of the base relative to the frame.

As shown in FIG. 2, hooks 2*k* and 2*m* at the lower ends of the legs have upper surfaces 2*r* and 2*s* that slant upwardly as they extend inwardly. When the legs are spread part to receive the base therebetween, the legs straighten out partially and these slanted surfaces level off partially as shown in FIG. 1. Thus, the legs provide a bias inwardly against the base to pinch the base therebetween. These slanted surfaces on the hooks along with the unrolling of the curvature in the legs provide a lifting bias to the base to press the base tightly against the upper part of the frame. The tapering of the legs distributes the stresses evenly therealong so that the strain is more uniform. These legs do not unroll or straighten out completely when the base is snap-in assembled therebetween but retain some of their curvature as shown in FIG. 1. In this manner, these legs will accommodate bases having different dimensional tolerances of as much as 0.025 inch in height yet holding them rigidly in place.

Base 8 is provided with a compartment 8*c* in which the switch contacts are mounted.

As shown in FIG. 1, the base is provided with means for registering it laterally on the frame. This means comprises three pairs of narrow, low elongated ridges or flanges embracing the legs and cover portion of the frame between the flanges of these pairs thereof. These flanges include forward and rear flanges 8*d* and 8*e*, respectively, extending to the left from the left-hand end corners of the base and being elongated to extend from the top of the base ⅔ way toward notch 8*a*. Similar forward and rear flanges 8*f* and 8*g*, respectively, extend to the right from the right-hand end corners of the base and are elongated to extend from the top of the base ⅔ way toward notch 8*b*. The third pair of flanges include a rear upright flange 8*h* extending almost the length of the base along its upper, rear corner, and a similar flange, not shown, extending almost the length of the base along its upper, forward corner to confine the cover portion of the frame therebetween. The left and right end flanges confine the legs of the frame therebetween to prevent any lateral movement of the base.

While the apparatus hereinbefore described is effectively adapted to fulfill the objects stated, it is to be understood that the invention is not intended to be confined to the particular preferred embodiment of electric switch having a frame with improved snap-in base retention means disclosed, inasmuch as it is susceptible of various modifications without departing from the scope of the appended claims.

We claim:

1. An electric switch comprising:

a switch housing comprising a base enclosing switch contacts and a frame overlying said base and having an aperture;

an actuator mounted to said frame and extending through said aperture for operating the switch contacts within said base;

and means for snap-in mounting said frame and base to one another comprising:

undercut portions on opposite ends of said base;

a pair of spaced, depending legs on said frame curving gradually inwardly toward one another and tapering downwardly toward their lower ends for even stress distribution and having hooks at their lower ends; said legs being flexible to afford spreading thereof to receive said base therebetween so that said hooks snap-in to grip said undercut portions while said hooks and the upward and inward stresses or forces in said legs resulting from the forced partial unrolling of the curvature in said legs provide inward and upward bias on said base to secure it rigidly to said frame while taking up small dimensional tolerances in said base.

2. The electrical switch defined in claim 1, wherein:

said hooks comprise inwardly and upwardly directed upper-surfaced shoulders on said legs that level out partially responsive to said partial unrolling on assembly of said base to said frame to provide said upward bias to said base.

3. The electrical switch defined in claim 1, wherein:

said legs comprise generally rectangular plates integral with and depending from the opposite ends of said frame, reducing in thickness while curving inwardly toward their lower ends and terminating at their lower ends in said hooks.

4. The electrical switch defined in claim 3, wherein:

said hooks comprise acute angle shoulders extending laterally across the lower ends of said legs.

5. The electrical switch defined in claim 4, wherein:

said hooks are provided with notches on their inwardly and downwardly facing surfaces to receive a tool to facilitate spreading thereof when assembling the base therebetween.

6. A toggle switch comprising:

a switch housing comprising a molded, insulating open-top base enclosing switch contacts and an insulating frame overlying said base and closing the top thereof and having an upstanding bushing thereon;

a toggle lever mounted to said frame in said bushing and extending through said bushing for operating the switch contacts within said base;

and means for snap-in mounting said base to said frame comprising:

notches in the opposite ends of said base;

a pair of flat legs integral with and depending from opposite ends of said frame, curving gradually inwardly and tapering in thickness toward their lower ends for uniform stress distribution and having inwardly-directed hooks thereat, said legs being flexible to afford spreading thereof to embrace said base so that said hooks snap-in grip said notches on the ends of said base while said hooks and the inward and upward stresses in said legs resulting from partial straightening of the inward curvature in said legs provides inward and upward pressure on said base to hold it tightly against said frame while taking up any dimensional tolerances in said base.

7. The toggle switch defined in claim 6, wherein:

said hooks have inwardly and upwardly slanted upper surfaces that along with the curvature stress in said legs apply a lifting force to said base to retain it rigidly against said frame.

8. The toggle switch defined in claim 6, wherein:

said legs comprise low, lateral ridges on the inner surfaces near the top thereof for centering said base and providing clearance thereabove for any molding flashing that remains at the upper corners of said base.

* * * * *